US005271541A

United States Patent [19]

Roux

[11] Patent Number: 5,271,541

[45] Date of Patent: Dec. 21, 1993

[54] SUPPLY DEVICE FOR A MACHINE WORKING PERIODICALLY ON A WEB OF MATERIAL IN STOPPED POSITION

[75] Inventor: Jean-Pierre Roux, Ardon, France

[73] Assignee: Komori-Chambon, Orleans la Source, France

[21] Appl. No.: 858,115

[22] Filed: Mar. 26, 1992

[51] Int. Cl.[5] ..... B65H 20/12

[52] U.S. Cl. ..... 226/95

[58] Field of Search ..... 226/7, 97, 95, 113, 226/114, 118

[56] References Cited

U.S. PATENT DOCUMENTS 3,774,829 11/1973 Francia ..... 226/97

4,888,848 12/1989 Serracant-Clermont et al. ... 226/95 X 5,094,377 3/1992 Stahlecker ..... 226/95 X

FOREIGN PATENT DOCUMENTS 2618770 2/1989 France .

*Primary Examiner*—Daniel P. Stodola

*Assistant Examiner*—Paul T. Bowen

*Attorney, Agent, or Firm*—McAulay Fisher Nissen Goldberg & Kiel

[57] ABSTRACT

A supply device for a machine periodically working on a web of material in a stopped position, particularly a flat cutting press, comprising, upstream of the machine, a hollow suction cylinder over which the web passes before penetrating in the machine. A vacuum source is provided to create a depression and a valve is provided to cyclically vary the depression in the suction cylinder between a first, relatively high value, substantially during the phase of the cycle of the machine corresponding to the acceleration of the web, and a second, relatively low value, during the rest of the cycle.

7 Claims, 1 Drawing Sheet

SUPPLY DEVICE FOR A MACHINE WORKING PERIODICALLY ON A WEB OF MATERIAL IN STOPPED POSITION

FIELD OF THE INVENTION

The present invention relates to a supply device for a machine working periodically on a web of material in stopped position, this web being delivered at constant speed upstream of the machine, applicable more particularly but not exclusively to the supply of a flat cutting press.

BACKGROUND OF THE INVENTION

In a flat cutting press which effects cyclic cutting of a continuous web, printed or not, of a material such as cardboard, this web is generally continuously delivered upstream from a reel. As the flat cutting press is a machine which necessitates a momentary stop of the advance of the web of material, during the cutting operation, there is produced, due to the continuous supply, an accumulation of the material to be cut, upstream of the cutting press. In order to be able to accumulate the length of web delivered continually upstream, whilst a downstream part of this web is in stopped position in the flat cutting press, various devices have already been designed which store the excess length of the web in the form of a loop of variable length which is either free or controlled by passing beneath a mobile cylinder, called "oscillating cylinder". This loop lengthens during stop of the cutting press and it shortens as soon as supply of the cutting press resumes, with a view to a subsequent cutting operation, these operations taking place cyclically.

A supply device of this type, which is described in Patent FR-A-2 618 770, further comprises, between the mobile cylinder controlling formation of the loop of variable length, and the flat cutting press, a suction cylinder, over part of the periphery of which the web to be cut passes before entering the press. This suction cylinder is hollow, its lateral wall is pierced with holes and inside the suction cylinder is housed a suction box which is connected to a source of vacuum and which is in contact with a part of the inner surface of the hollow suction cylinder. The position of the suction box and its extension in the direction of rotation of the suction cylinder correspond to the zone in which the web is in contact with the outer surface of the suction cylinder. This suction cylinder is, furthermore, driven in rotation at a constant peripheral speed which is greater than the speed of supply of the web upstream. Such a suction cylinder serves to maintain the web under tension and it ensures acceleration of the web when, after a cutting operation in stopped position, this web is again introduced inside the cutting press.

In such a known supply device, the inner box of the suction cylinder is permanently subjected to a constant depression created by the source of vacuum. This results, during the phase of stop of the web inside the cutting press, in a certain instability of this web on the suction cylinder, since this cylinder is permanently rotating and its holes which pass beneath the web, then immobilized, attract, due to the depression present, zones of the web which move thereon. Furthermore, as the depression prevailing in the suction box is chosen to be sufficiently high to obtain a good acceleration of the web, when the latter must be advanced in the cutting press, there results a relatively high pressure of application of the web immobilized on the outer surface of the suction cylinder in rotation, detrimental to the quality of certain materials when a very high speed is attained.

It is an object of the present invention to overcome these drawbacks.

SUMMARY OF THE INVENTION

To that end, this supply device for a machine working periodically on a web of material in the stopped position, this web being delivered at constant speed upstream of the machine, applicable more particularly but not exclusively, to the supply of a flat cutting press, comprising, upstream of the machine, means for forming, with the web, an intermediate loop of variable length, a suction cylinder over the surface of which passes the web before penetrating in the machine and means for creating a depression inside the suction cylinder, is characterized in that the depression-creating means are designed so as cyclically to vary the depression in the suction cylinder between a first, relatively high, value during the phase of acceleration of the web following the operation effected in the machine, and a second, relatively low, value during the rest of the cycle corresponding to the deceleration of the web and to its immobilization in the machine.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
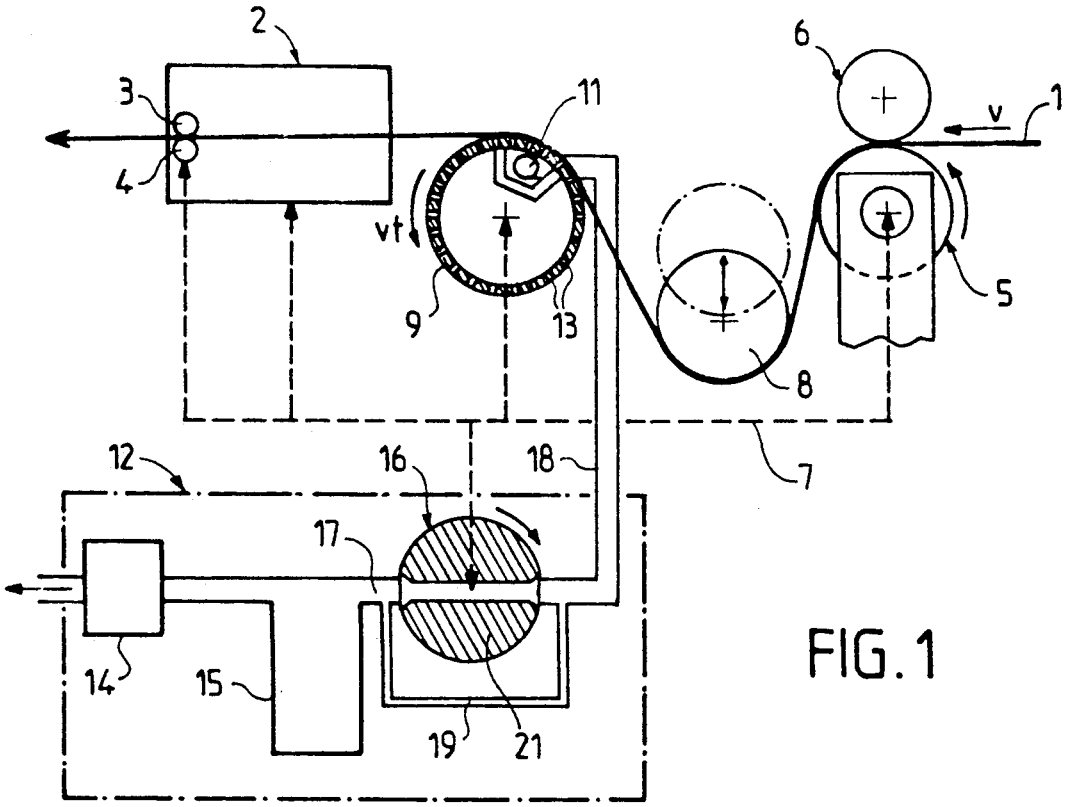
FIG. 1 is a schematic view in elevation of a supply device for a flat cutting press working on a web of material in stopped position, according to the invention.

Referring now to the drawings, the supply device according to the invention, which is shown in FIG. 1, is intended to ensure intermittent supply of a web 1 of any material, for example cardboard, printed or not, which is worked in stopped position by a fashioning machine 2 located downstream, such as for example a flat cutting press. The web 1 is continuously supplied upstream, at a constant speed v, from any source, such as a reel, and it moves from right to left in FIG. 1, in the direction of the cutting press 2. On leaving this cutting press 2, the sheet is detached from the web 1 and drawn towards the left, after a cutting operation, by means of a pair of intake and counter-rollers 3, 4 tangential to each other, of horizontal, transverse axes.

In its upstream part, the supply device comprises two horizontal, transverse tangential rollers between which web 1 passes, namely a lower intake roller 5 and an upper counter-roller 6. The lower intake roller 5 is driven in rotation from a general control of the machine 7, indicated by broken lines, and it rotates with a peripheral speed equal to the speed v of web 1. On leaving rollers 5 and 6, web 1 forms a loop of variable length by passing beneath a mobile cylinder 8, also called "oscillating cylinder". This oscillating cylinder is well known in the art and may be borne by a pair of arms oscillating about the axis of the lower intake roller 5, being driven positively in rotation from this cylinder, as described in Patent FR-A-2 618 770.

After having passed beneath the mobile cylinder 8, the web rises towards the left and is applied over a part of the periphery of a suction cylinder or "sliding" cylinder 9 of horizontal, transverse axis. This suction cylinder 9 is located before the entry of web 1 in the cutting press 2, at a level such that the web 1 leaving the suction cylinder 9 and penetrating the cutting press 2 is located substantially at the level where the cutting operation must be effected in the press 2. The suction cylinder 9 which is hollow, is driven in rotation from the general control 7 of the cutting press and it rotates at a constant peripheral speed $v_t$ which is greater than the speed v of the web and oriented in the same direction thereas, in the zone of contact of the web 1 and the suction cylinder 9. Inside this suction cylinder 9 is located a suction box 11 which communicates with a source of vacuum 12. This suction box 11 is in contact with a part of the inner surface of the suction cylinder 9 whose lateral wall is pierced with regularly distributed holes 13. The position of the suction box 11 and its extension in the direction of rotation of the suction cylinder 9 correspond to the zone of contact of the web 1 on the outer surface of the suction cylinder 9, i.e. substantially in the upper right quadrant of the cylinder 9 as shown in FIG. 1.

During a cutting operation, the web 1 is stopped in the cutting press 2 in which it is located between two horizontal beams of which one is fixed and the other vertically mobile, one of these beams bearing the cutting form. During such a cutting operation, since, upstream, the web 1 continues to be supplied at speed v by rollers 5 and 6, the loop formed by the web around the mobile cylinder 8 lengthens and this cylinder descends. Once the cutting operation is terminated, the web 1 resumes advance in the cutting press 2, after the two beams of the press have moved apart, the web then being pushed towards the left by the suction cylinder 9 of press 2. During this web advance resumption phase, the suction cylinder 9 which rotates constantly at peripheral speed $v_t$, contributes to the acceleration of the web towards the cutting press 2.

Figure 3:
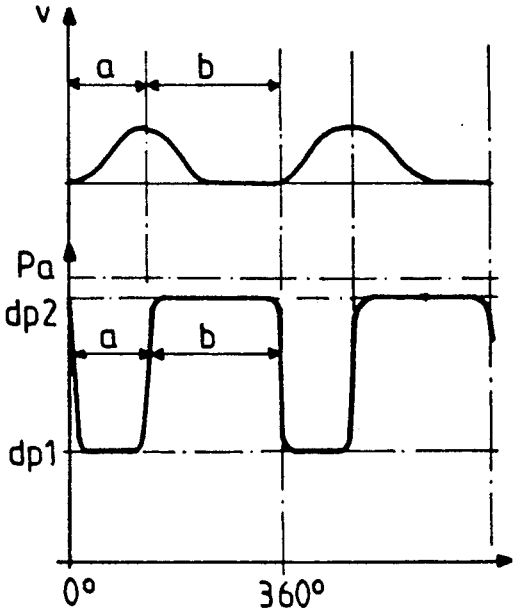
FIG. 3 is a diagram illustrating the variation of the depression in the suction box of the suction cylinder during a cycle of the cutting press.

According to the invention, the vacuum source 12 creates, in the suction box 11, a depression which is variable in the cycle of the cutting press 2. More particularly, as shown in the diagram of FIG. 3, in the upper part of which is represented the variation of the speed V of the web 1 in the cutting press 2, the depression dp, with respect to atmospheric pressure Pa, which is created in the suction box 11 by the vacuum source 12, may take two values, namely a first, relatively high, value dp1 during the phase a of the cycle corresponding substantially to the period of acceleration of the web 1, upon resumption of advance thereof, and a second value dp2, lower than the preceding one, during the remaining phase b of the cycle corresponding to the deceleration of the web and to its immobilization during the cutting operation. By way of example, the ratio between the depressions Dp1 and Dp2 is included between 3 and 5. Consequently, the high depression dp1 is present solely when it is necessary, i.e. during the phase of acceleration of the web. During the rest of the cycle, the weak depression dp2 prevailing in the suction box 11 brings about a very slight friction of the web 1 in contact with the suction cylinder 9 which rotates permanently. This is translated by a slight heating and an excellent stability of the web 1 when stopped.

Figure 2:
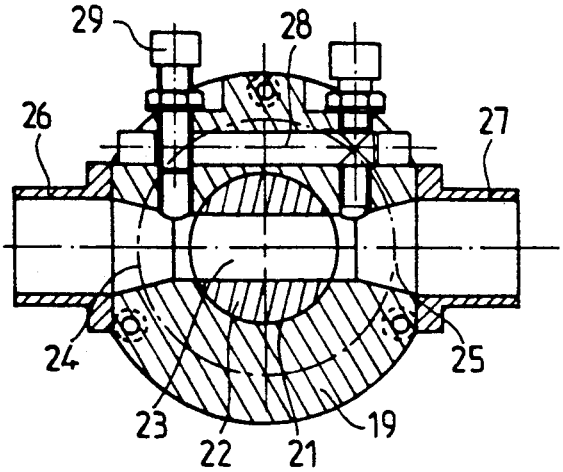
FIG. 2 is a view in section of the device for cyclic control of the depression in the suction cylinder.

The cyclic variation of the depression produced by the vacuum source 12 may advantageously be obtained by the means indicated schematically within the rectangle in dashed and dotted lines. The source of vacuum 12 comprises a vacuum generator 14, constituted for example by a blower, whose suction orifice is connected to a cyclonic barrel 15. With this cyclonic barrel 15, which performs the role of vacuum acculumator (buffer tank) and of recuperator of impurities, there communicates a valve 16 for cyclic control of the depression, of which valve the mobile obturator is driven from a general control 7 of the cutting press 2, so as to vary the depression prevailing in the suction box 11 and consequently in the suction cylinder 9, between the two values dp1 and dp2, during each cycle of the cutting press 2. The valve 16 for cyclically controlling the depression is mounted between the cyclonic barrel 15 and the suction box 11 to which it is connected by conduits 17 and 18 respectively. According to an advantageous embodiment, as shown in FIG. 2, the valve 16 for cyclically controlling the depression comprises a cylindrical body 19 provided with a coaxial cylindrical bore 21. In this bore is rotatably mounted a cylindrical plug 22 constituting the mobile obturator of the valve 16, which is pierced right through with a diametral passage 23, of large transverse section and of which the two ends pass in front of the orifices of two diametrically opposite conduits 24, 25 pierced in body 19. These conduits communicate, outside body 19, with connections 26, 27 to which conduits 17 and 18 are respectively connected. Furthermore, in body 19 of the valve are pierced conduits defining a passage 28 of smaller transverse section than that of diametral passage 23 and which is established as a branch conduit on this passage 23, opening out at its two ends in the two conduits 24 and 25 respectively. An adjustable screw 29 makes it possible to vary as desired the free section of the branch passage 28. The cylindrical obturator plug 22 is driven in rotation, by an appropriate mechanism, from the general control 7 of the machine 2, so as to effect a half-revolution per machine cycle. It is set angularly so as to establish a communication between conduits 17 and 18, through the diametral passage 23 of large transverse section, during a rotation of the cylindrical plug 22 by an angle corresponding substantially to the phase of acceleration a of the web, which angle is of the order of 120°. Due to the large transverse section of the diametral passage 23, the high depression which is permanently created in the cyclonic barrel 15, is transmitted virtually instantaneously, as soon as communication is established through the diametral passage 23, to conduit 18 so that the high depression dp1 prevails in the suction box 11, during the web acceleration phase a. The suction cylinder 9 then performs its role of accelerator of the web 1, during this phase. Immediately after this phase, the cylindrical plug 22 has rotated sufficiently to interrupt any communication through the diametral passage 23 and there only remains the communication established through the passage 28 of small transverse section. Due to the necking made by this conduit, the depression in the suction box 11 is considerably reduced and it attains the lower value dp2. As indicated hereinabove, this low value makes it possible to reduce friction of the web 1 on the permanently rotating suction cylinder 9, whilst maintaining it in contact with this cylinder whilst said web is stopped, and to increase its stability since web 1 is less stressed upon passage of each hole 13 of the suction cylinder 9.

What is claimed is:

1. In a supply device for a machine working periodically on a web of material in the stopped position, this web being supplied at constant speed upstream of the machine comprising, upstream of the machine, means for forming with the web an intermediate loop of variable length during a momentary stop of the machine a hollow suction cylinder whose surface is pierced with holes and over which passes the web before penetrating in the machine, means for creating a variable depression inside the suction cylinder, and means to control the variable depression creating means for cyclically varying the depression in the suction cylinder between a first, relatively high value, substantially during the phase of the cycle of the machine corresponding to the acceleration of the web following the operation effected in the machine, and a second, relatively low value, during the rest of the cycle corresponding to the deceleration of the web and to its immobilization in the machine.

2. The device of claim 1, wherein the means creating a variable depression in the suction cylinder comprise a valve for cyclically controlling the depression, said valve including a mobile obturator driven from the general control of the machine.

3. The device of claim 2, wherein the valve for cyclically controlling the depression is mounted between a vacuum accumulator (buffer tank), itself connected to a vacuum generator, and the interior of the suction cylinder.

4. The device of claim 2, wherein a passage of small transverse section extends as a branch conduit on said mobile obturator.

5. The device of claim 4, wherein the valve for cyclically controlling the depression comprises a cylindrical body provided with a coaxial cylindrical bore, in which bore is rotatably mounted a cylindrical plug constituting the mobile obturator of the valve, which is pierced right through with a diametral passage of large transverse section and whose two ends pass in front of the orifices of two diametrically opposite conduits pierced in the body, and, furthermore, in the body of the valve, are pierced conduits defining the passage of transverse section smaller than that of the diametral passage and which is established as a branch conduit on this passage.

6. The device of claim 5, wherein an adjustable screw or a valve makes it possible to vary as desired the free section of the branch conduit passage.

7. The device of claim 5, wherein the cylindrical obturator plug is driven in rotation by an appropriate mechanism from the general control of the machine, so as to effect a half-revolution per machine cycle and it is angularly set so as to establish a communication through the diametral passage of large transverse section, during a rotation of the cylindrical plug through an angle corresponding substantially to the phase of acceleration of the web.

* * * * *